US006651641B1

(12) United States Patent
Bower et al.

(10) Patent No.: US 6,651,641 B1
(45) **Date of Patent: *Nov. 25, 2003**

(54) SILENCER FOR A CROSSBOW

(75) Inventors: Mark A. Bower, Tallmadge, OH (US); David A. Choma, Akron, OH (US)

(73) Assignee: Horton Manufacturing Company Inc., Tallmadge, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 7 days.

(21) Appl. No.: 10/189,984

(22) Filed: Jul. 4, 2002

Related U.S. Application Data

(60) Provisional application No. 60/303,561, filed on Jul. 6, 2001.

(51) Int. Cl.[7] ..... F41B 5/12; F41B 5/10

(52) U.S. Cl. ..... 124/25; 124/25.6; 124/92

(58) Field of Search ..... 124/25, 25.6, 90, 124/92

(56) References Cited

U.S. PATENT DOCUMENTS

| | | | | | |
|---|---|---|---|---|---|
| 4,080,951 | A | * | 3/1978 | Bateman | 124/92 |
| 4,207,858 | A | * | 6/1980 | Blackstone | |
| 4,603,676 | A | * | 8/1986 | Luoma | 124/25 |
| 5,553,597 | A | * | 9/1996 | Sparks | 124/25.6 X |
| 6,237,584 | B1 | * | 5/2001 | Sims | 124/92 |
| 6,446,620 | B1 | * | 9/2002 | Summers et al. | 124/92 |

* cited by examiner

*Primary Examiner*—John A. Ricci
(74) *Attorney, Agent, or Firm*—Renner, Kenner, Greive, Bobak, Taylor & Weber

(57) ABSTRACT

A crossbow (10) includes a barrel (11) which carries a bow (13) which includes limbs (15, 16) having outer ends (17, 18). A bowstring (22) is carried between the limb ends (17, 18) and is movable between a relaxed position and a cocked position. When so moving, the cables (23, 24), which are part of a compound rigging system (19), and which extend between the limb ends (17, 18), will want to vibrate causing an undesirable noise. But such is thwarted or otherwise minimized by tubular sheaths (27, 28) positioned around the cables (23, 24) to engage the cables (23, 24).

14 Claims, 3 Drawing Sheets

SILENCER FOR A CROSSBOW

This application claims the benefit of provisional application ser. No. 60/303,561 filed Jul. 6, 2001.

TECHNICAL FIELD

This invention relates to a crossbow having a device which deadens the sound of its firing. More particularly, this invention relates to a device which reduces the sound emanating from the cables of a compound bow when the bow is fired.

BACKGROUND ART

Compound crossbows are well known in the art. In these devices, a crossbow is provided with a rigging system which provides a mechanical advantage for the user when drawing the bowstring to cock the crossbow and also increases the efficiency of the unit. The rigging system includes, among other items, one or more cables which extend between the spaced tips of the limbs of the bow. These cables are preferably made of a metallic material and are positioned close to, but spaced from, each other as they traverse the area between the limb tips. While this system renders a crossbow much easier to cock, upon firing the crossbow, the cables vibrate and can engage each other to emit an oftentimes reasonably loud harmonic noise. Such a noise can be irritating to the user, particularly if he is hunting game in an otherwise quiet and peaceful outdoor environment. Moreover, the sound of a firing crossbow emitted from the vibrating cables can alert potential prey of the presence of a hunter.

In an attempt to deaden this sound, some crossbow users have utilized clips to hold the cables together in an effort to eliminate the vibration thereof. However, such clips are not only susceptible to being dislodged and potentially lost upon firing of the crossbow, but also they tend to only change the tone of the noise rather than deaden it, much like one's finger on a guitar string changes the tone thereof.

Some crossbow manufacturers have attempted to deal with the problem by replacing the metallic cables with cables formed of some type of synthetic material such as a polyester or the like. While the vibration of such synthetic cables does not produce as much sound as is produced by the metallic cables, they are more expensive to produce, their manufacture to the required precise lengths being difficult and labor intensive. In addition to being more costly, the performance of the synthetic cables does not match that of the metallic cables. In particular, temperature and moisture variances which can be encountered by the crossbow user and hunter can cause an uneven expansion and/or contraction of the synthetic cables thereby detracting from the efficiency thereof. Finally, the life span of synthetic cables is shorter, requiring more frequent replacement than their metallic counterparts.

The need exists, therefore, for a crossbow which can use metallic cables as riggings for a compound system without creating an undesirable noise upon the firing thereof.

DISCLOSURE OF THE INVENTION

It is thus an object of the present invention to provide a crossbow with a sound deadening feature.

It is another object of the present invention to provide a crossbow, as above, with a rigging system rendering it a compound crossbow while still deadening the sound emanating therefrom when the crossbow is fired.

It is a further object of the present invention to provide a crossbow, as above, in which the rigging system may include a plurality of metallic cables which are prevented from vibrating when the crossbow is fired.

These and other objects of the present invention, as well as the advantages thereof over existing prior art forms, which will become apparent from the description to follow, are accomplished by the improvements hereinafter described and claimed.

In general, a crossbow made in accordance with the present invention includes a barrel carrying a bow which has spaced limb ends. A bowstring extends between the limb ends and at least one cable likewise extends between the limb ends. A tubular sheath is positioned around the cable between each limb end and the barrel. The sheath engages at least a portion of the cable to lessen the vibration thereof when the bowstring moves as the crossbow is fired.

In accordance with another aspect of the present invention, a compound bow has spaced limb ends and a bowstring is carried between the ends. The bowstring is movable between a cocked position and a relaxed position. At least one cable extends between the limb ends and is capable of vibrating when the bowstring is moving from the cocked position to the relaxed position. A sheath surrounds the cable and reduces the vibrations thereof when the bowstring moves from the cocked to the relaxed position.

A preferred exemplary crossbow incorporating the concepts of the present invention is shown by way of example in the accompanying drawings without attempting to show all the various forms and modifications in which the invention might be embodied, the invention being measured by the appended claims and not by the details of the specification. dr

PREFERRED EMBODIMENT FOR CARRYING OUT THE INVENTION

Figure 1:
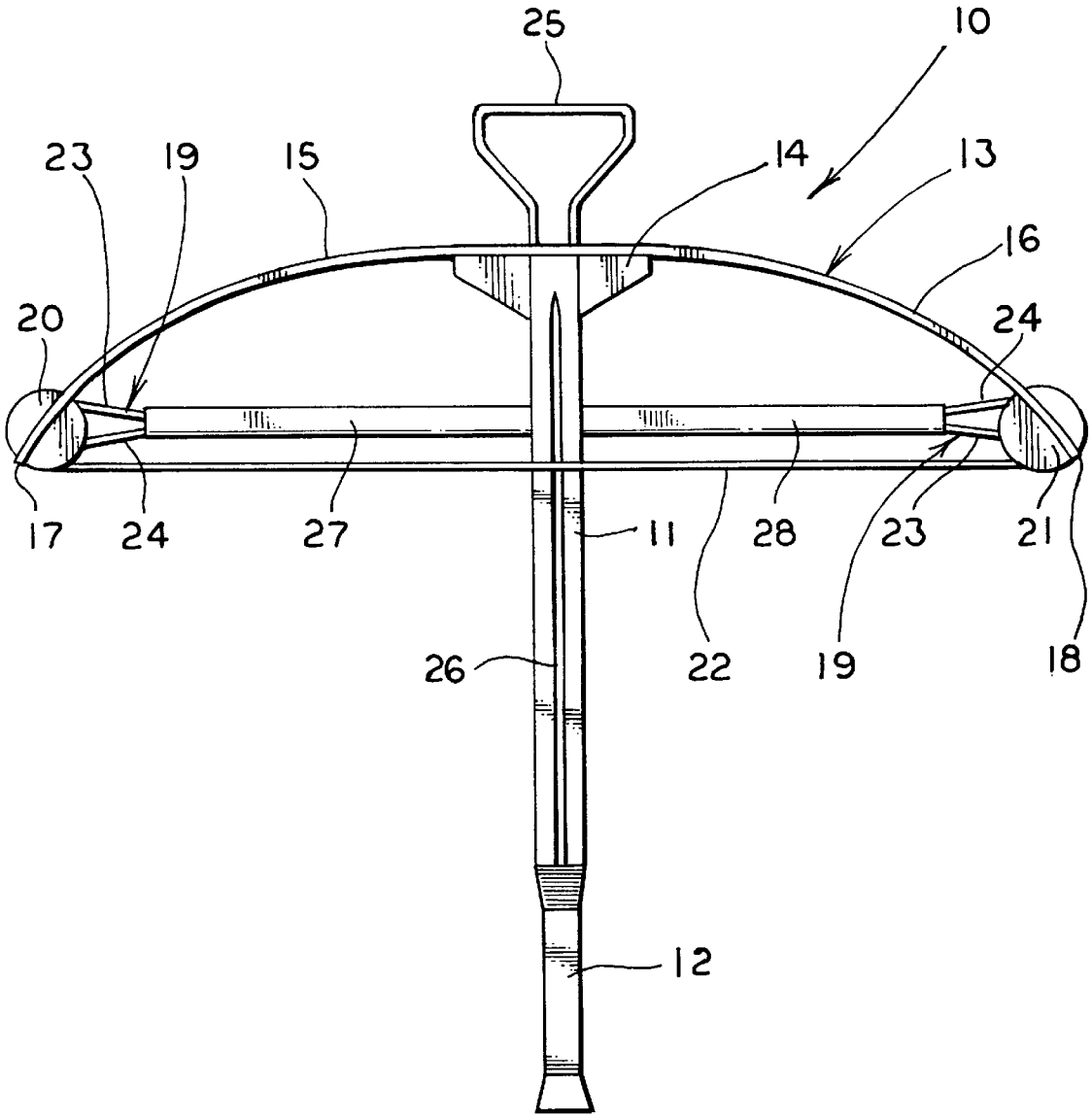
FIG. 1 is a top plan view of a crossbow made in accordance with the present invention having tubular sheaths surrounding the cables of the compound rigging system and shown in the uncocked condition.

A crossbow made in accordance with the present invention is generally indicated by the numeral 10 and includes an elongate barrel 11 having a stock 12 at one end thereof adapted to rest against the user's shoulder. The barrel 11 and stock 12 can be separate items attached together or can be formed as one piece. A bow, generally indicated by the numeral 13, is carried by a riser 14 positioned at the other end of barrel 11. Bow 13 typically includes flexible limbs 15 and 16, one of which is positioned on each side of barrel 11. Alternatively, limbs 15 and 16 can be integrally formed as a single item. In either event, limbs 15 and 16 have free outer ends 17 and 18, respectively.

Crossbow 10 is of the type commonly known as a compound crossbow wherein a mechanical advantage is obtained when cocking the crossbow by virtue of a conventional compound rigging system generally indicated by the numeral 19. As is known in the art, system 19 includes an eccentric cam wheel 20 mounted on free end 17 of limb 15 and another eccentric cam wheel 21 mounted on free end 18 of limb 16. System 19 also includes a plurality of cables 22, 23 and 24. Cable 22 extends between wheels 20 and 21 and represents the bowstring for crossbow 10. Cable 23, which is preferably made of a metallic material but which could be made of a synthetic material, extends from wheel 20, passes through barrel 11, and is positioned around wheel 21 where it is attached. Cable 24, which is preferably made of a metallic material but which could be made of a synthetic material, extends from wheel 21, passes through barrel 11, and is positioned around wheel 20 where it is attached. As shown, cables 23 and 24 cross each other generally at the area of barrel 11 and are farthest away from each other generally near ends 17 and 18 of bow 13.

Figure 2:
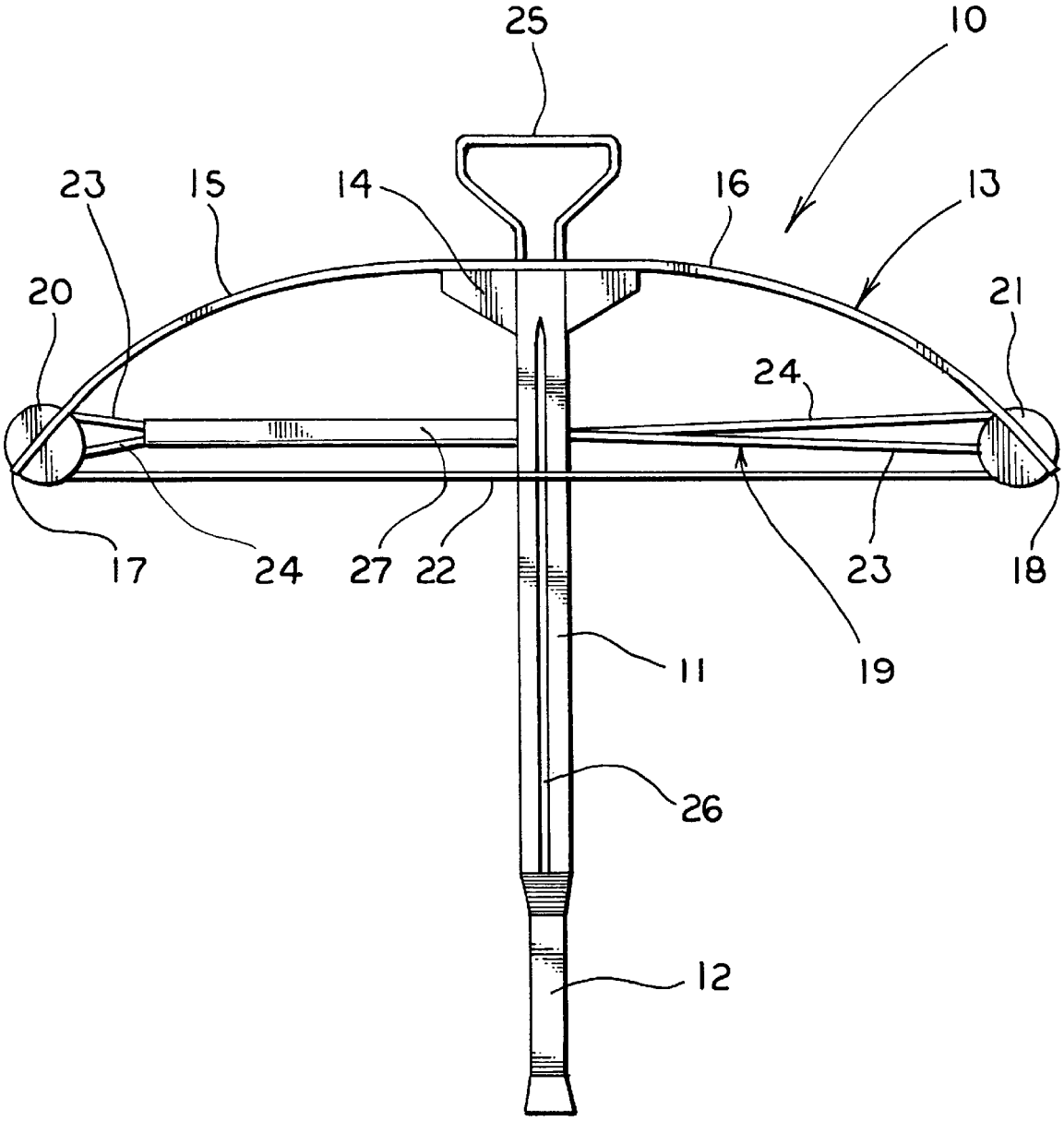
FIG. 2 is a top, plan view of a crossbow similar to FIG. 1 but having one sheath removed to expose the cables positioned thereunder.
Figure 3:
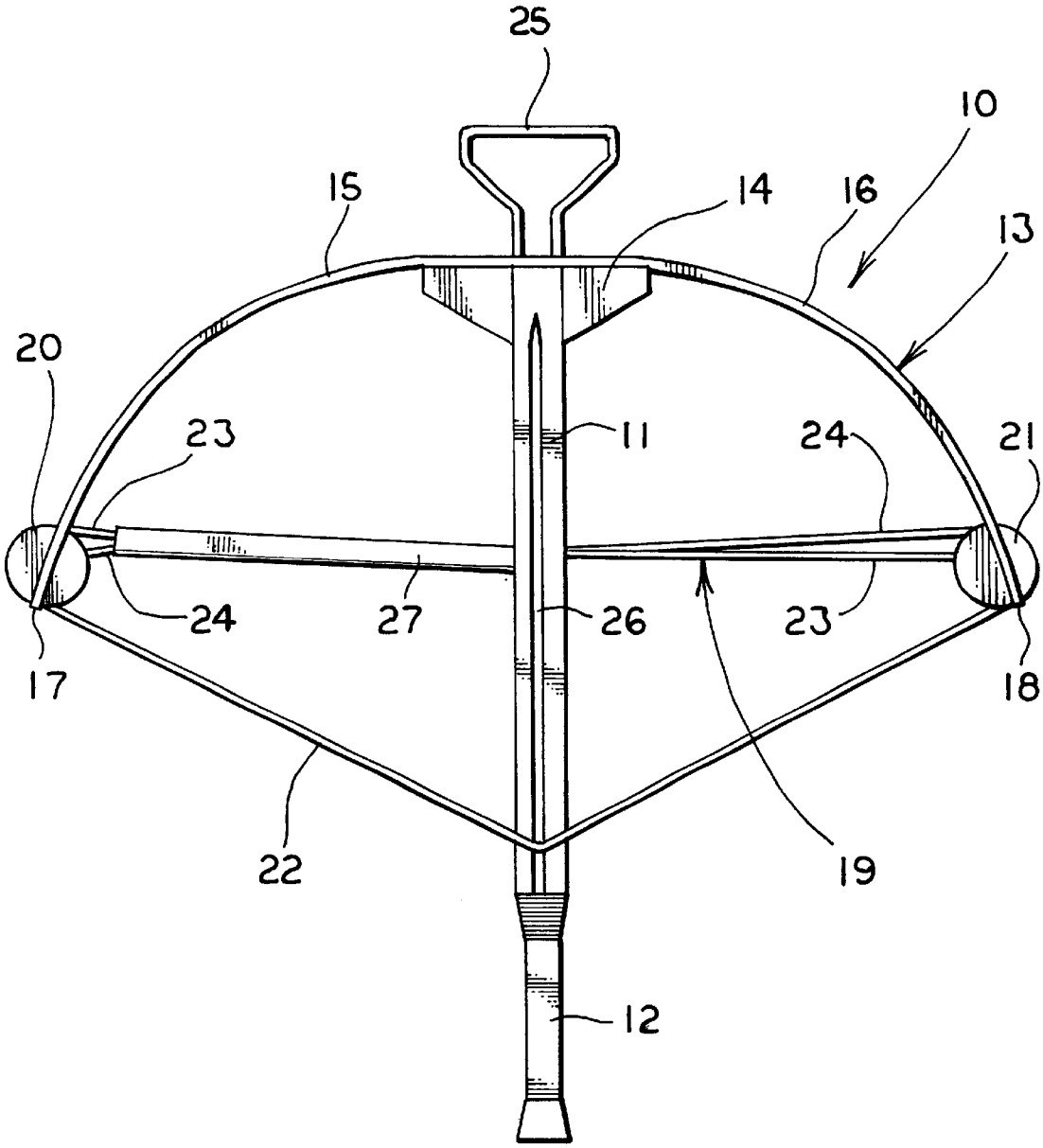
FIG. 3 is a top plan view of a crossbow similar to FIG. 1 but showing the crossbow in the cocked condition and having one sheath removed to expose the cables positioned thereunder.

Crossbow 10 is shown in the uncocked position in FIGS. 1 and 2 with bowstring 22 in a relaxed condition, and is shown in the cocked position in FIG. 3, bowstring 22 having been pulled away from bow 13. A stirrup 25 mounted at the end of barrel 11 may assist the user in cocking crossbow 10. That is, by placing stirrup 25 on the ground and putting one's foot in it, bowstring 22 may be more easily pulled. Moreover, compound rigging system 19 provides a mechanical advantage, as is known in the art, to allow one to cock crossbow 10 with less force than would otherwise be required. Once crossbow 10 is cocked, an arrow may be placed in an arrow guide 26 formed in barrel 11 and upon activation of a trigger mechanism (not shown) carried by barrel 11, the arrow may be propelled.

As is evident when comparing the exposed portions of cables 23 and 24 in FIG. 2 versus FIG. 3, at their ends adjacent to ends 17 and 18 of bow 13, cables 23 and 24 are closer to each other when crossbow 10 is in the cocked condition shown in FIG. 3 than they are when in the uncocked condition shown in FIG. 2. As such, when crossbow 10 is fired and returned from its cocked position to its uncocked position, cables 23 and 24 will want to move from the FIG. 3 to the FIG. 2 position. In the prior art, during such movement, noises would be generated therefrom. These noises are particularly prevalent if cables 23 and 24 are formed of a metallic material, but exist as well if cables 23 and 24 are formed of a synthetic material.

However, in accordance with the present invention, tubular sheaths 27 and 28 are provided to dampen any such vibration and the concomitant noise. Thus, sheath 27 is positioned around cables 23 and 24 between bow end 17 and barrel 11, and sheath 28 is positioned around cables 23 and 24 between bow end 18 and barrel 11. It should be noted that in FIGS. 2 and 3, sheath 28 has been shown as being removed for ease of discussing the orientation and spacing of cables 23 and 24, as just described above, it being understood that an operating crossbow 10 would have both sheaths 27 and 28 in place.

Sheaths 27 and 28 can be made of any suitable sturdy, resilient material such as rubber, fabric reinforced rubber, or any other suitable elastomeric material. The inner diameter of each tubular sheath 27, 28 is preferably sized so that at least a portion of it along its length will be in contact with cables 23 and 24 as crossbow 10 is being fired. As a result, it is evident that the inner diameter of tubular sheaths 27, 28 will be smaller than the distance between the unadjacent outer surfaces of cables 23 and 24 when crossbow 10 is in the uncocked FIG. 2 position. Also, preferably that inner diameter is generally equivalent to the distance between the unadjacent outer surfaces of cables 23 and 24 when crossbow 10 is in the cocked position. That is, sheaths 27 and 28 are preferably almost touching or just touching cables 23 and 24 in the cocked position. Sheaths 27 and 28 are preferably of a length so as to substantially extend the entire distance between barrel 11 and limb tips 17 and 18. However, the length of sheaths 27 and 28 cannot be that entire distance when crossbow 10 is in the uncocked position because when crossbow 10 is moved from the uncocked position to the cocked position, the distance between limb tips 17,18 and barrel 11 decreases. Thus, the maximum and most desired length of sheaths 27 and 28 is the distance between barrel 11 and limb tips 17 and 18 in the cocked position.

In view of the foregoing, it should be evident that upon the firing of crossbow 10, cables 23 and 24 will want to move and vibrate as they separate from the cocked position to the uncocked position. However, sheaths 27 and 28 will engage cables 23 and 24 to not only impede their movement, but also to otherwise substantially diminish the noise emanating therefrom. As a result, crossbow 10 accomplishes the objects of the present invention and otherwise substantially improves the art.

What is claimed is:

1. A crossbow comprising a barrel, a bow carried by said barrel and having spaced limb ends, a bowstring extending between said limb ends and being moveable from a position to cock the crossbow to an uncocked position when the crossbow is fired, at least one cable extending between said limb ends, and a tubular sheath positioned around said cable between each said limb end and said barrel, said sheaths engaging at least a portion of said cable to lessen the vibration of said cable when the crossbow is fired.

2. The crossbow of claim 1 wherein there are two cables extending between said limb ends.

3. The crossbow of claim 2 wherein said two cables are spaced from each other along a portion of their length.

4. The crossbow of claim 3 wherein said cables cross each other near said barrel and are spaced the farthest from each other near said limb ends.

5. The crossbow of claim 3 wherein the spacing of said cables is greater when the crossbow is in the uncocked position.

6. The crossbow of claim 5 wherein the inner diameter of said tubular sheath is less than the spacing of the unadjacent outer surfaces of said cables in the uncocked position.

7. The crossbow of claim 5 wherein the inner diameter of said tubular sheath is generally equivalent to the spacing of the unadjacent outer surfaces of said cables when in the cocked position.

8. The crossbow of claim 1 wherein the spacing between said limbs is less when the crossbow is in the cocked position, and the length of said sheathes is generally equivalent to the space between said limb ends and said barrel in the cocked position.

9. A compound bow having spaced limb ends, a bowstring carried between said limb ends and being movable between a cocked position and a relaxed position, at least one cable extending between said limb ends and being capable of vibrating when said bowstring moves from the cocked position to the relaxed position, and a sheath surrounding said cable and reducing the vibration thereof when said bowstring moves from the cocked position to the relaxed position.

10. The compound bow of claim 9 further comprising a second cable extending between said limb ends, said second cable having at least a portion thereof spaced from said cable.

11. The compound bow of claim 10 wherein the spacing between said cables is greatest near said limb ends.

12. The compound bow of claim 10 wherein the spacing between said cables is greater when said is in the relaxed position.

13. The compound bow of claim 12 wherein said sheath is generally tubular having an inner diameter less than the spacing of the unadjacent outer surfaces of said cables when said bowstring is in the relaxed position.

14. The compound bow of claim 12 wherein said sheath is generally tubular having an inner diameter generally equivalent to the spacing of the unadjacent outer surfaces of said cables when said bowstring is in the cocked position.

* * * * *